US010650689B2

(12) United States Patent
Sinkiewicz

(10) Patent No.: US 10,650,689 B2
(45) Date of Patent: May 12, 2020

(54) WAVEFORM AUTHENTICATION SYSTEM AND METHOD

(71) Applicant: The MITRE Corporation, McLean, VA (US)

(72) Inventor: Daniel Sinkiewicz, Milford, NH (US)

(73) Assignee: The MITRE Corporation, McLean, VA (US)

( * ) Notice: Subject to any disclaimer, the term of this patent is extended or adjusted under 35 U.S.C. 154(b) by 0 days.

(21) Appl. No.: 15/800,516

(22) Filed: Nov. 1, 2017

(65) Prior Publication Data

US 2019/0027049 A1 Jan. 24, 2019

Related U.S. Application Data

(60) Provisional application No. 62/415,907, filed on Nov. 1, 2016.

(51) Int. Cl.
*G08G 5/04* (2006.01)
*G08G 5/00* (2006.01)

(52) U.S. Cl.
CPC ..... *G08G 5/045* (2013.01); *G08G 5/0008* (2013.01); *G08G 5/0021* (2013.01); *G08G 5/0078* (2013.01)

(58) Field of Classification Search
CPC combination set(s) only.
See application file for complete search history.

(56) References Cited

U.S. PATENT DOCUMENTS 5,940,135 A * 8/1999 Petrovic ..... H04H 20/31 348/473
6,674,861 B1 * 1/2004 Xu ..... G10L 19/018 380/252
6,999,598 B2 2/2006 Foote et al.
7,730,307 B2 6/2010 Viggiano et al.
7,876,259 B2 1/2011 Schuchman
8,917,201 B2 12/2014 Malaga
8,918,326 B1 * 12/2014 Blesser ..... H04N 19/467 704/500
9,019,939 B2 4/2015 Anand et al.
2001/0032313 A1 * 10/2001 Haitsma ..... G11B 20/00086 713/176
2003/0004589 A1 * 1/2003 Bruekers ..... G06T 1/0064 700/94
2004/0042619 A1 3/2004 Yamaguchi
2005/0180315 A1 * 8/2005 Chitrapu ..... H04B 7/2628 370/208

(Continued)

FOREIGN PATENT DOCUMENTS

CN 106935079 7/2017

OTHER PUBLICATIONS

Goergen et al., "Physical Layer Authentication Watermarks Through Synthetic Channel Emulation", 2010, IEEE Communication Society (Year: 2010).*

(Continued)

*Primary Examiner* — Zhiyu Lu
(74) *Attorney, Agent, or Firm* — Morrison & Foerster LLP

(57) ABSTRACT

The present disclosure is directed to systems and methods to add information to an existing waveform. Specifically, the systems and methods described herein can add watermark information using transmitted-reference to a legacy waveform without actually controlling the legacy waveform itself.

18 Claims, 13 Drawing Sheets

(56) References Cited

U.S. PATENT DOCUMENTS

| | | | | |
|---|---|---|---|---|
| 2005/0240767 | A1* | 10/2005 | Lemma | G06T 1/0028 713/176 |
| 2005/0240768 | A1* | 10/2005 | Lemma | G06T 1/005 713/176 |
| 2011/0206137 | A1* | 8/2011 | Filippi | H04L 5/0048 375/240.26 |
| 2013/0159722 | A1* | 6/2013 | Goergen | H04N 1/32144 713/176 |
| 2015/0221317 | A1* | 8/2015 | Baum | G10L 19/018 704/500 |

OTHER PUBLICATIONS

Haomiao, Yang et al. (2014) "EBAA: An efficient broadcast authentication scheme for ADS-B communication based on IBS-MR," Chinese Journal of Aeronautics, 27(3); 9 pages.

Kacem, Thabet et al. (2015) "Secure ADS-B Design & Evaluation," Proceedings of the 2015 IEEE International Conference on Vehicular Electronics and Safety, Yokohama, Japan; 6 pages.

* cited by examiner

WAVEFORM AUTHENTICATION SYSTEM AND METHOD

CROSS-REFERENCE TO RELATED APPLICATION

This application claims the benefit of U.S. Provisional Application No. 62/415,907, filed on Nov. 1, 2016, the entire contents of which is incorporated herein by reference.

FIELD OF THE DISCLOSURE

This disclosure relates to systems and methods for applying a synthetic channel to a radio's transmitted signal while embedding information in the properties of the synthetic channel. More particularly, this disclosure relates to systems and methods for using transmitted-reference, in the form of an appliqué, to add information to a legacy radio waveform.

BACKGROUND OF THE DISCLOSURE

There are many legacy waveforms that are currently in use today for different types of critical applications such as for use in aircraft collision avoidance. For example, the Aircraft Communications and Reporting System (ACARS) and the Automatic Dependent Surveillance-Broadcast (ADS-B) are legacy waveforms for transmissions between aircraft and ground stations. FIG. 1 illustrates an example of a typical ADS-B system 100. As shown in ADS-B system 100, radio signals carrying ADS-B waveforms are transmitted by aircraft 102 and 104 to each other and to ADS receiver 108 to broadcast GPS position. GPS position can be obtained by aircraft 102 based on, for example, information received from a global navigation satellite system 108. These ADS-B waveform transmissions can be used by air traffic management 106 and other aircraft to assess traffic situations and to prevent aircraft collision.

SUMMARY OF THE DISCLOSURE

Applicants have discovered a way for information (e.g., in the form of a watermark) to be added to a waveform without actually controlling the waveform itself. The information added can be embedded on top of the underlying waveform in the form of an echo of the underlying waveform (i.e., a watermark), rather than adding it to the payload of the waveform itself. As such, the embedded information (i.e., the watermark) in the composite signal can look like the underlying waveform passing through a naturally occurring channel. In effect, embodiments disclosed herein impose a synthetic channel with specific properties onto the underlying waveform.

Many legacy waveforms do not incorporate strong authentication mechanisms. Accordingly, the information added to the waveform can be integrity/authentication information. However, the added information may not necessarily be limited to integrity/authentication information. As such, any supplemental data (e.g., control data) can be added to a legacy waveform according to the methods and systems disclosed herein. For example, the watermark can be used to establish cross-radio communication, where two radios developed to process different waveforms (which otherwise could not communicate) can communicate (e.g., send control information) with each other via the common watermark. Accordingly, the technology disclosed herein can allow radios built for different purposes to coordinate in their use of a shared spectrum (e.g., when two radios using different modulation schemes are sharing spectrum and can agree on channel access).

In some embodiments, a synthetic multipath channel can be applied to radio's transmitted (i.e., modulated) signal by embedding information in the signal in the form of a watermark generated based on an underlying waveform. On the receiving end, the received signal can be analyzed to determine the information contained in the synthetic channel. This technology can be implemented in the form of an appliqué, added to an output port of a transmitter and an input port of a receiver. As such, information sent in this manner can be supplemental to the data being sent over the underlying waveform, such as integrity or control information.

Some embodiments include a system comprising a radio transmitter that transmits a radio signal; a watermark transmitter that adds watermark information to the radio signal; a watermark receiver that receives the radio signal comprising the watermark information, wherein the watermark receiver can decode the watermark information; and a radio receiver that receives the decoded radio signal. In some embodiments, the watermark transmitter adds watermark information to the radio signal using transmitted-reference modulation. In some embodiments, adding the watermark information to a first radio signal comprises copying the radio signal to form a second radio signal; delaying the second radio signal based on the watermark information; and scaling the delayed second radio signal based on the watermark information; and combining the delayed and scaled second radio signal with the first radio signal to form a combined radio signal.

In some embodiments, the watermark information includes authentication information. In some embodiments, the authentication information is generated using Timed Efficient Stream Loss-Tolerant Authentication (TESLA). In some embodiments, the radio signal is a legacy waveform. In some embodiments, the legacy waveform includes Automatic Dependent Surveillance-Broadcast (ADS-B).

In some embodiments, the watermark receiver decodes the watermark information using transmitted-reference modulation. In some embodiments, decoding the watermark information comprises calculating a correlation of the combined radio signal based on a delay. In some embodiments, performing the correlation comprises delaying the combined radio signal based on the delay; multiplying the combined radio signal with the delayed combined radio signal to form a product radio signal; and integrating the product radio signal over a chip time. In some embodiments, the watermark transmitter is attached to an output port of the radio transmitter. In some embodiments, the watermark receiver is attached to an input port of the radio receiver.

Some embodiments include a method comprising adding watermark information to a radio output signal; receiving the radio signal comprising the watermark information; and decoding the watermark information. Some embodiments include a method of transmitting a radio signal; adding watermark information to the radio signal; receiving the radio signal comprising watermark information; decoding the watermark information; and receiving the decoded radio signal. In some embodiments, the watermark information is added to the radio signal using transmitted-reference modulation. In some embodiments, adding the watermark information to the radio signal comprises copying a first radio signal to form a second radio signal; delaying the second radio signal based on the watermark information; scaling the second radio signal based on the watermark information;

and combining the delayed and scaled second radio signal with the first radio signal to form a combined radio signal. In some embodiments, the watermark information comprises authentication information. In some embodiments, the authentication information is generated using TESLA. In some embodiments, the radio signal is a legacy waveform. In some embodiments, the legacy waveform includes ADS-B. In some embodiments, the watermark information is decoded using transmitted-reference modulation. In some embodiments, decoding the watermark information comprises delaying the combined radio signal; multiplying the combined radio signal with the delayed combined radio signal to form a product radio signal; and integrating the product radio signal over a chip time.

Some embodiments include an electronic device comprising one or more processors; memory; and one or more programs, wherein the one or more programs are stored in the memory and configured to be executed by the one or more processors, the one or more programs including instructions for any of the methods described in the above paragraph. Some embodiments include a non-transitory computer readable storage medium storing one or more programs, the one or more programs comprising instructions, which when executed by an electronic device, cause the device to perform any of the methods described in the above paragraphs.

As used herein, the singular forms "a," "an," and "the" are intended to include the plural forms as well, unless the context clearly indicates otherwise. It is also to be understood that the term "and/or" as used herein refers to and encompasses any and all possible combinations of one or more of the associated listed items. It is further to be understood that the terms "includes, "including," "comprises," and/or "comprising," when used herein, specify the presence of stated features, integers, steps, operations, elements, components, and/or units but do not preclude the presence or addition of one or more other features, integers, steps, operations, elements, components, units, and/or groups thereof.

Additional advantages will be readily apparent to those skilled in the art from the following detailed description. The examples and descriptions herein are to be regarded as illustrative in nature and not restrictive.

BRIEF DESCRIPTION OF THE DRAWINGS

Exemplary embodiments are described with reference to the accompanying figures, in which.

DETAILED DESCRIPTION

Figure 1:
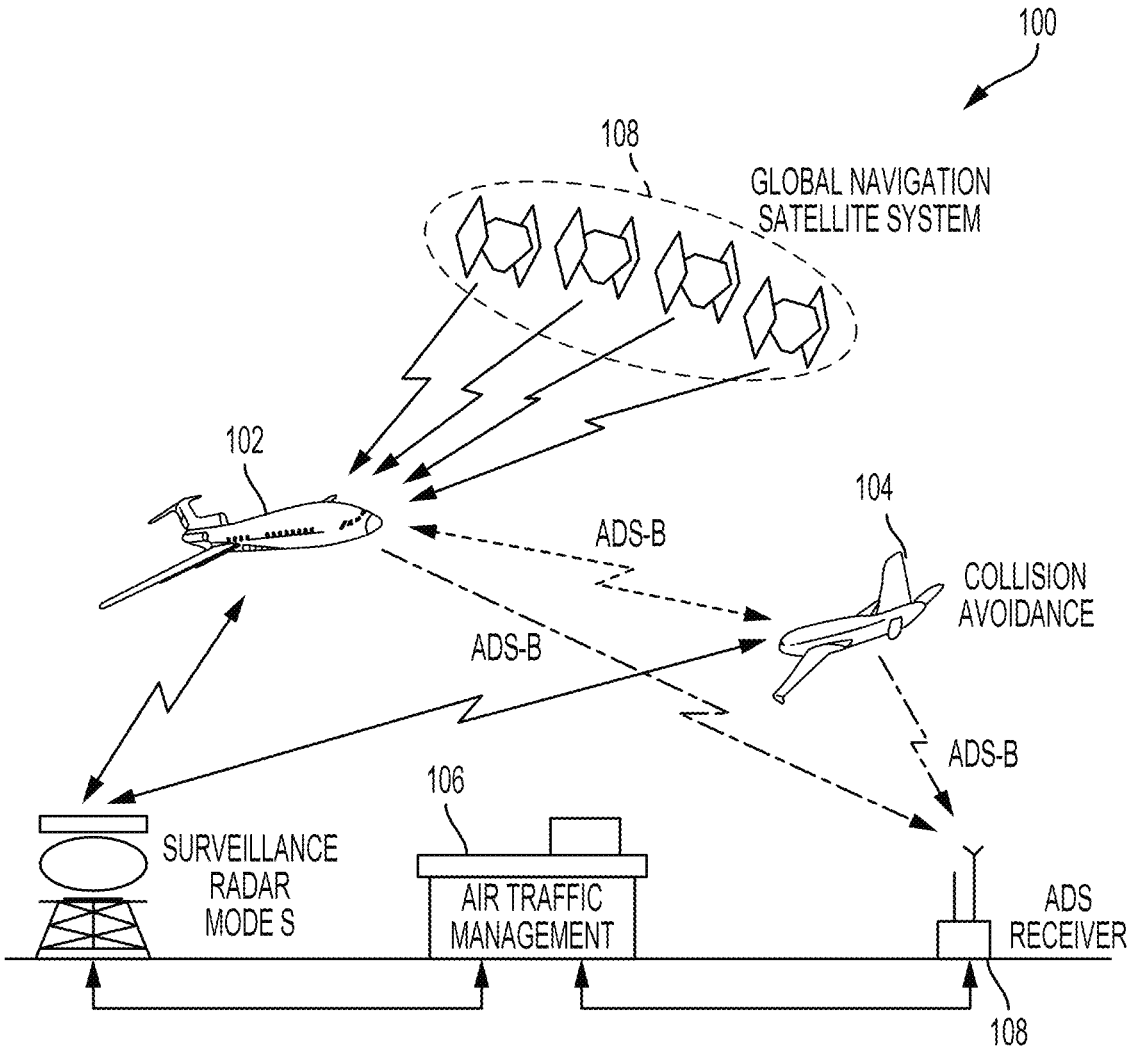
FIG. 1 illustrates an example ADS-B system.

Applicants have discovered systems and methods of adding a watermark to a waveform at the physical layer of the networking stack. These watermarks can serve a multitude of purposes such as adding integrity/authentication to an otherwise unprotected waveform without modifying the transmitting radio. Accordingly, Applicants have established a minimally intrusive method for adding information to a signal transmitted by a radio without having control of the radio itself. In some embodiments, the watermarking can be performed using an appliqué (i.e., a watermark transmitter and/or watermark receiver) that can attach to the input/output ports of the radios used. As such, the addition of the watermark can be independent of the underlying waveform (i.e., ownership of underlying waveform is not required) and can be implemented in the form of an appliqué. In addition, the watermark information can be added to the transmitted signal as a synthetic echo.

In the following description of the disclosure and embodiments, reference is made to the accompanying drawings, in which are shown, by way of illustration, specific embodiments that can be practiced. It is to be understood that other embodiments and examples can be practiced, and changes can be made without departing from the scope of the disclosure.

Some portions of the detailed description that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that, throughout the description, discussions utilizing terms such as "processing," "computing," "calculating," "determining," "displaying," "obtaining," or the like, refer to the action and processes of a computer system, or similar electronic computing device, that manipulates and transforms data represented as physical (electronic) quantities within the computer system memories or registers or other such information storage, transmission, or display devices.

Certain aspects of the systems and methods of creating embedded information waveforms include process steps and instructions described herein in the form of an algorithm. It should be noted that the process steps and instructions of these systems and methods could be embodied in software, firmware, or hardware and, when embodied in software, could be downloaded to reside on and be operated from different platforms used by a variety of operating systems.

The systems and methods disclosed herein can also relate to a device for performing the operations herein. This device may be specially constructed for the required purposes, or it may comprise a general-purpose computer selectively activated or reconfigured by a computer program stored in the computer. Such a computer program may be stored in a non-transitory, computer-readable storage medium, such as, but not limited to, any type of disk, including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Furthermore, the computers referred to in the specification may include a single processor or may be architectures employing multiple processor designs for increased computing capability.

The methods, devices, and systems described herein are not inherently related to any particular computer or other apparatus. Various general-purpose systems may also be used with programs in accordance with the teachings herein, or it may prove convenient to construct a more specialized apparatus to perform the required method steps. The required structure for a variety of these systems will appear from the description below. In addition, the methods, devices, and systems described herein are not described with reference to any particular programming language. It will be appreciated that a variety of programming languages may be used to implement the teachings of the methods, devices, and systems as described herein.

A watermark can be a type of marker that is covertly embedded in a signal such as an audio, video, or image data. The process of watermarking can be embedding information in a carrier signal. In some embodiments, the carrier or original radio signal can be a legacy waveform such as ACARS or ADS-B. As such, these radio signals can already have modulated information. Accordingly, Applicants have discovered a method and system that can add additional information to this already modulated information. Watermarks can be used to verify the authenticity or integrity of the carrier signal or to show the identity of its owners. In other embodiments, the watermark can be used to incorporate supplemental information in the carrier signal.

Figure 2:
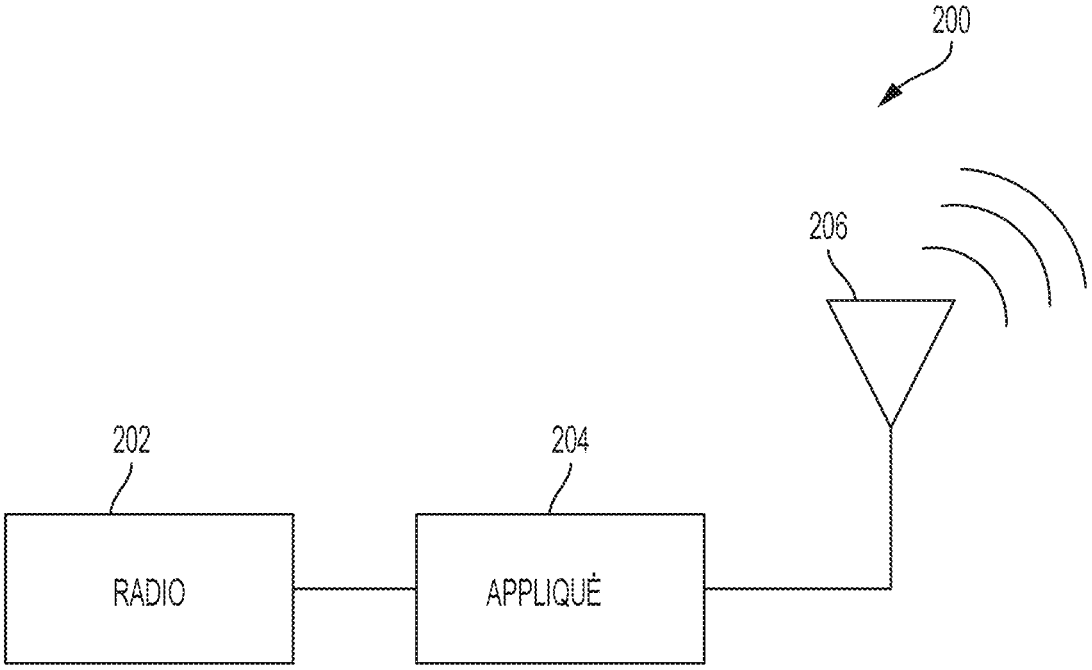
FIG. 2 illustrates an example of a watermarking system, according to some embodiments.

FIG. 2 illustrates an example watermarking system 200 including an appliqué 204 that modifies the signal transmitted by a radio 202 to add a watermark, according to some embodiments. Appliqué 204 can be coupled to the I/O port(s) of radio 202 (i.e., be external to radio 202) and can add watermarks to outgoing messages (e.g., a radio signal to be transmitted) and decodes watermarks on incoming messages (e.g., a received radio signal). As such, instead of making changes to radio 202 itself, the watermark can be implemented as an appliqué on top of the radio signal generated by radio 202. Accordingly, the systems and methods disclosed herein can be implemented with existing radio transmitters in, for example, radio 202. In other embodiments, the functionality of appliqué 204 can be implemented internally with respect to radio 202.

In some embodiments, appliqué 204 can be plugged in between radio 202 and antennae 206 of the transmitter radio and/or appliqué 204 can be plugged in between antennae 206 and radio 202 of the receiver radio. As such, the watermarking appliqué can be hardware inserted between an antennae and a transmitter. Such hardware can be used in order to add the watermark and in order to decode the watermark. One of the benefits of the systems and methods disclosed herein is that it can interfere minimally with existing systems. For example, if the transmitter does not include the watermarking appliqué hardware, the transmitter can still transmit the original radio signal and if the receiver does not include the watermarking appliqué hardware, the receiver can still receive either the original or modified radio signal and derive from it the original signal. In some embodiments, the hardware can be a software-defined radio implemented in software/firmware. In some embodiments, the software/firmware in the software-defined radio can implement transmitted-reference as explained below.

Figure 3:
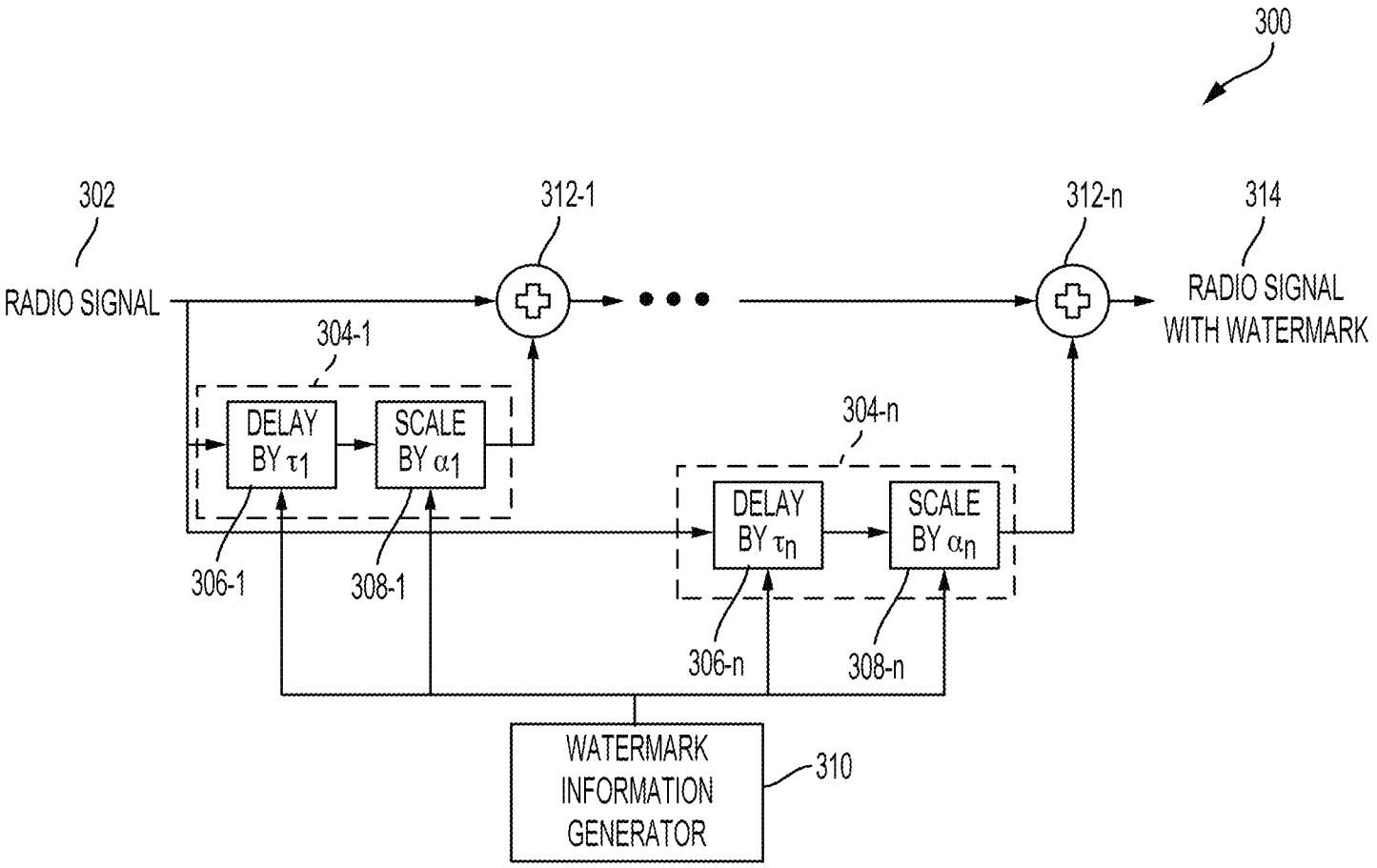
FIG. 3 illustrates an example of watermark transmission performed by an appliqué, according to some embodiments.

FIG. 3 illustrates an example of watermark transmission performed by an appliqué 300, according to some embodiments. For example, appliqué 300 may be an example of appliqué 204 as described with respect to FIG. 2. In some embodiments, appliqué 300 can add a watermark to an original (i.e., carrier) signal, e.g., radio signal 302, based on a transmitted-reference related process. Transmitted-reference is explained in the article "Delay-Hopped Transmitted-Reference RF Communications" by Ralph Hoctor and Harold Tomlinson, 2002 IEEE Conference on Ultra Wideband Systems and Technologies, pp. 265-269, which is incorporated herein by reference in its entirety. In general, transmitted-reference communication systems can transmit two versions of a radio signal, the original signal and one modulated with a watermark.

Transmitted-reference modulation can add a watermark to a radio signal in the form of a delayed copy of the original radio signal mimicking a naturally occurring phenomenon in the physics of waves called multipath, whereby a wave from a source travels to a detector via two or more paths. In general, multipath can be detrimental to communications because these two or more paths can interfere and make it more difficult for radio receivers to recover the original radio signal. Current transmitted-reference communication systems may impose a synthetic channel, inducing synthetic multipath, as a way to more easily recover the original radio signal. In contrast, Applicants have embraced multipath as a method of transmitting additional information. In particular, appliqué 300 can embed watermark information in one or more synthetic multipath channel(s), according to some embodiments. In addition, transmitted-reference is currently used as a distinct form of communication which uses pulses as the underlying waveform. In contrast, the underlying waveform disclosed herein is information bearing as well and the transmitted-reference modulation described below can add supplemental information to the link.

In some embodiments, watermark transmission performed by appliqué 300 can be implemented in software (e.g., software-defined radio), as described with respect to FIG. 2. In other embodiments, appliqué 300 can be implemented in hardware. As shown in FIG. 3, a radio signal 302 can be copied, delayed, and scaled (amplitude-wise) based on watermark information to be embedded, and added back to the radio signal 302. In some embodiments, as described with respect to FIG. 2, radio signal 302 can be generated by a conventional radio 202. In some embodiments, appliqué 300 implements one or more watermarking units 304-1 . . . **304-*n* to add a corresponding one or more watermarks to radio signal 302 to generate a radio signal 314 with watermark for transmission over an antenna, such as antenna 206 as described with respect to FIG. 2. In some embodiments, as will be further described below, watermarking components 304-1 . . . 304-*n* can include corresponding delay components 306-1 . . . 306-*n* and scaling components 308-1 . . . 308-*n* for adding, via one or more summer components 312-1 . . . 312-*n*, one or more delayed and scaled copies of the original radio signal 302 to radio signal 302. In some embodiments, the size of the delay ($\tau$) as imposed by, e.g., delay component 306-1, and the amplitude ($\alpha$) as imposed by, e.g., scaling component 308-1, can depend on the watermark information as generated by watermark information generator 310**.

Figure 4:
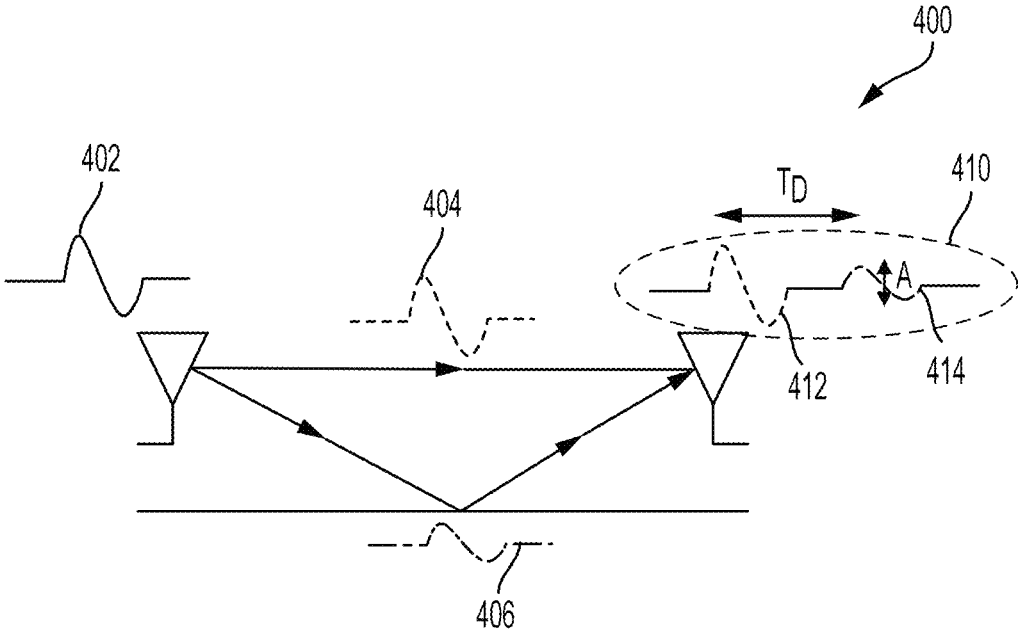
FIG. 4 illustrates an example diagram showing generation of a transmitted-reference signal, according to some embodiments.

FIG. 4 illustrates an example diagram 400 showing generation of a transmitted-reference, according to some embodiments. For example, an original radio signal 402 can be added with a delayed and amplified copy of radio signal 402. This delayed and amplified copy 406 can look like a multipath channel associated with a delay (e.g., time delay $T_D$) and a scaling (e.g., amplitude A). In some embodiments, as described with respect to FIG. 300, a copy 404 of radio signal 402 can be added, via a summer component, with delayed and scaled copy 406 to generate a composite radio signal 410. As shown in diagram 400, composite radio signal 410 includes portions 412 and 414 that correspond to copy 404 and delayed and scaled copy 406, respectively. Accordingly, adding a delayed and scaled version of an original radio signal to the original signal effectively imposes a synthetic channel to the original signal. As discussed in the present disclosure, the delayed and scaled version of the original radio signal can be referred to as an echo signal. In some embodiments, the original radio signal can be increased to n copies and a corresponding n delayed and scaled copies of the original radio signal can be generated, where n depends on the acceptable levels of degradation to an underlying waveform of the original radio signal. An advantage that can be provided by introducing n echoes, i.e., n delayed and scaled copies of the original radio signal, include the capability to embed more watermark information within composite radio signal 410.

Returning to FIG. 3, a copy of radio signal 302 can be input to summer component 312-1 to be added with a delayed and scaled copy of radio signal 302 as generated by watermarking component 304-1. In some embodiments, watermarking component 304-1 receives a copy of radio signal 302. Next, delay component 304-1 can add a delay to the copy of radio signal 302 (e.g., samples of radio signal 302) by holding the copy of radio signal 302 by a time delay ($\tau_1$). An output of delay component 304-1 can be scaled by scaling component 308-1 by a scale ($\alpha_1$). The output of scaling component 308-1 can represent a delayed and scaled copy of radio signal 302 to be added to radio signal 302 by summer component 312-1. As discussed above, summer 312-1 can be implemented in hardware or a combination of software/firmware. In some embodiments, values for delays ($\tau$) and scales ($\alpha$) can be configured by appliqué 300 to embed specific watermark information. In some embodiments, appliqué can implement a plurality of watermarking components 304-1 . . . **304-*n*** for adding different delays ($\tau_1 \ldots \tau_n$) and/or different scales ($\alpha_1 \ldots \alpha_n$).

In some embodiments, the size of one or more delays ($\tau$) and the size of one or more scales ($\alpha$) can be determined by watermark information generator 310 to embed specific watermark information in an echo of radio signal 302. For example, if there are two values for $\tau$ (e.g., 5 or 10) and two values for $\alpha$ (e.g., +1 or −1), there can be four different combinations (e.g., ($\tau$=5; $\alpha$=+1); ($\tau$=5; $\alpha$=−1); ($\tau$=10; $\alpha$=+1); or ($\tau$=10; $\alpha$=−1)). Accordingly, an echo signal generated by, e.g., watermarking component 304-1, having a selected delay ($\tau_1$) and a selected scale ($\alpha_1$) can be generated to transmit one of four numbers (e.g., 0, 1, 2, and 3) which is equivalent to two bits (e.g., "0-0," "0-1," "1-0," and "1-1"). As such, if a 2-bit value of "0-0" is to be transmitted, there can be a selection of $\tau_1$=5 and $\alpha_1$=+1 used to generate the echo signal output by watermarking component 304-1. If the next two bits to be transmitted are "0-1," there can be a selection of $\tau_1$=5 and $\alpha_1$=−1 by watermark information generator 310. In some embodiment, each of one or more watermarking component 304-1 . . . **304-*n* can be hardcoded with a unique combination of a delay ($\tau$) and a scale ($\alpha$). In this embodiment, watermarking information generator 310 can select one of watermarking components 304-1 . . . 304-*n* having a specific combination of a delay ($\tau$) and a scale ($\alpha$) to embed specific watermark information in an echo signal, according to some embodiments. In other embodiments, one or more of watermarking components 304-1 . . . 304-*n* can be configured at runtime to select a delay ($\tau$) and a scale ($\alpha$) to embed specific watermark information generated by watermark information generator 310. In some embodiments, a watermarking component, e.g., watermarking components 304-1, can be configured by watermarking information generator 310. As a result and as described below with respect to FIGS. 13A and 13**B, the watermark information can be represented by properties of an echo signal being generated based on a radio signal. For example, the radio signal may include a legacy waveform such as ADS-B.

In some embodiments, the watermark information (i.e., what the watermark carries) can be authentication or integrity information. In some embodiments, the watermark information can be generated by watermark information generator 310 using Timed Efficient Stream Loss-Tolerant Authentication (TESLA). TESLA is explained in the article "The TESLA Broadcast Authentication Protocol" by Adrian Perrig, Ran Canetti, J. D. Tygar, and Dawn Song, 2005 RSA CryptoBytes, 5 which is hereby incorporated by reference in its entirety. TESLA can use cryptographic functions to prove authentication. In some embodiments, the cryptographic functions can be fixed block sizes. For example, when discreet messages are being transmitted (i.e., it sends one message, waits, sends another message, waits), each one of these messages can have a full watermark block. As such, a radio receiver (e.g., appliqué 204) can determine the beginning and the end because the block sizes can be the same for each message, according to some embodiments. In some embodiments, watermark information being decoded by the radio receiver can be decoded to represent one watermark block in a TESLA hash chain.

Figure 5:
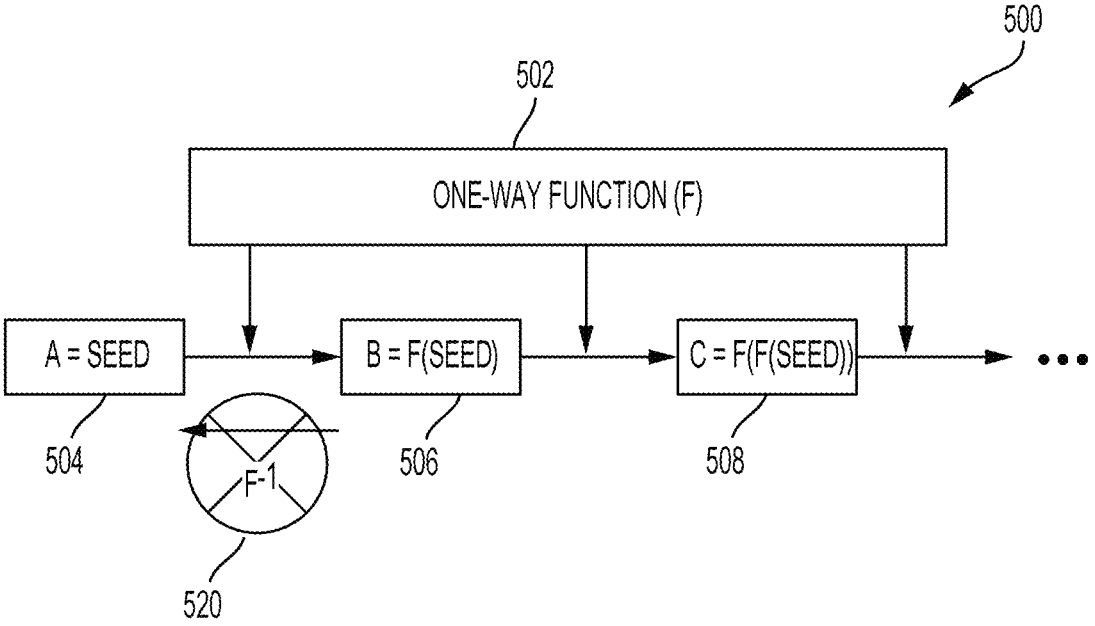
FIG. 5 illustrates an example diagram showing a hash chain generated based on a one-way function, according to some embodiments.

FIG. 5 illustrates an example diagram 500 showing a hash chain generated based on a one-way function (F) 502, according to some embodiments. In some embodiments, one-way function (F) 502 can be used to generate a plurality of watermark blocks 504, 506, and 508 in the hash chain. Watermark blocks 504, 506, and 508, may include corresponding values A, B, and C. TESLA can use a hash chain and delayed secret disclosure to establish integrity. For example, as described with respect to appliqué 300 of FIG. 3, watermark information generator 310 can generate watermark information including portions of a watermark block. One-way function (F) 502 can be a one-way hash function. A one-way hash function essentially does not have a known inverse function 520 as depicted in diagram 500. As shown in FIG. 5, one-way function (F) 502 can be applied to a value A (including a seed value) to generate a value B (F(seed) representing an output of one-way function F with input of a seed value). However, once the output of one-way function F (e.g., B=F(seed)) is generated, it is very difficult to get the input again. For example, TESLA can generate a hash chain by applying one-way function (F) 502 to successive outputs of one-way function (F) 502 starting with value A. For example, value B can be generated based on value A using the one-way function (F) 502. Similarly, a value C may be generated by applying one-way function (F) 502 to value B and successive hash values in the hash chain can be similarly generated. In some embodiments, values A, B, and C can be included in watermark blocks 504, 506, and 508 to form a hash chain of watermark blocks.

In some embodiments, a radio transmitter (e.g., an appliqué) may apply TESLA by sending a message with value B attached to it. By sending this message with value B attached, the radio transmitter is essentially saying that it is the only one who could have generated B and can prove it in its next message. The radio transmitter can then send the next message with value A attached to it. In some embodiments, a radio receiver receiving values B and A in successive message can input value A in a one-way function (F) corresponding to one-way function (F) 502 to determine if value A really was the input used by the radio transmitter to generate value B. If so, the radio receiver may determine that the radio transmitter is the only one who knew A, so the radio receiver must have also sent the message with value B. As such, the radio receiver can accept the message and then can buffer the message with A and wait for the next message and so on. Accordingly, there can be a time component for authentication of messages since the radio receiver waits to receive the next message used to authenticate a previous message. In some embodiments, the next message can include the next value in the TESLA hash chain as described and shown in diagram 500. A radio receiver can buffer this next message, and a subsequent message received can contain the next link (e.g., watermark block) in the hash chain used by the radio receiver to validate the previously buffered message. In some embodiments, a hash chain can be used for the data in the watermark (i.e., one watermark block can contain one link in the hash chain) as determined by watermark information generator 310 as described with respect to FIG. 3.

Most radios today have some built-in capacity to handle multipath and would be capable of being configured to decode embedded watermark information, as described in the present disclosure, because embodiments embed watermark information by applying a synthetic channel to radio signals to emulate multipath. As described with respect to FIGS. 3 and 4, a combined radio signal 314 can include two signals: a radio signal having an underlying waveform, and a multipath signal associated with watermark information. The multipath signal may be an echo signal generated based on the signal having the underlying waveform. In some embodiments, if a user does not care about the information included in the underlying waveform, the original, radio signal can be used as a carrier signal and the power for use in transmitting the multipath signal can be amplified (i.e., scaled) up to use the multipath signal as the main communication line. Alternatively, if the user still cares about the underlying waveform in the original radio signal, then the power for transmitting the multipath signal can be much lower.

In some embodiments, on the receiver side, the message (e.g., a radio signal with embedded watermark information) sent by a radio transmitter can be decoded. In some embodiments, a radio receiver may implement an appliqué (e.g., appliqué 204 of FIG. 2) to compare the original, received radio signal with a delayed copy of the original radio signal. The longer this comparison is done, the better or more accurate the decoding can be. In some embodiments, the radio receiver can be intelligently designed to determine where a watermark begins and where the watermark ends. For example, in some embodiments, the radio transmitter can turn on and transmit and then turn off. As such, every time a message (e.g., a radio signal with embedded watermark information) is detected by the radio receiver, the message can have a different watermark, and then the radio transmitter may turn off, and nothing can be heard by the radio receiver. When a new message is sent, the radio receiver can know that the new message is associated with a new channel (e.g., a synthetic channel) embedding different watermark information. In some embodiments, the radio transmitter can be continuously transmitting and an equalizer at the radio receiver can observe the channel to notify the watermark receiver (e.g., appliqué 204) when the observed channel changes. In other embodiments, the watermark receiver can keep a plot of different correlations that are determined based on a received message, watch the channel changes in real time, and select correlation peaks based off of these channel changes. In some embodiments, a header can be added to the watermarks to separate them so that the radio receiver can cut up messages that have been received, e.g., differentiate, between watermarks using the headers.

Figure 6:
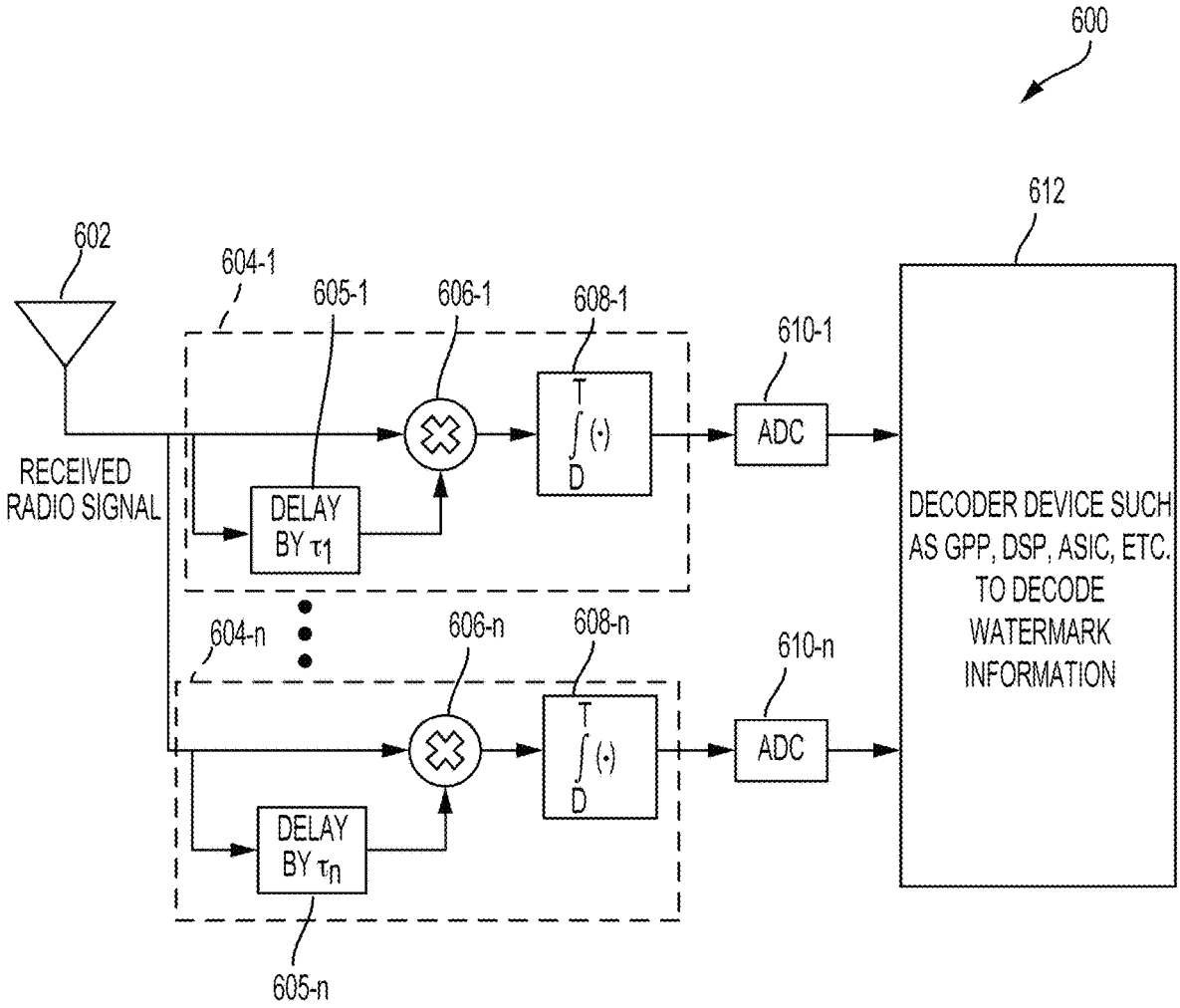
FIG. 6 illustrates an example of watermark reception performed by an appliqué, according to some embodiments.

FIG. 6 illustrates an embodiment of watermark reception performed by an appliqué 600, according to some embodiments. For example, appliqué 600 may be an example of appliqué 204 as described with respect to FIG. 2. In some embodiments, appliqué 600 can be implemented in hardware, as shown in FIG. 6. In other embodiments, the functionality of appliqué 600 can be implemented in software and hardware (e.g., implemented as a software-defined radio). In some embodiments, appliqué 600 identifies multipath, such as a synthetic channel applied to a radio signal, based on correlation to decode embedded watermark information. As shown in FIG. 6, a radio signal can be received by antenna 602 and processed by one or more banks of correlators (correlator 604-1 . . . **604-*n*) set to acceptable, corresponding delay values ($\tau 1$ . . . $\tau n$) to calculate the autocorrelation at relevant delays ($\tau$-1 . . . $\tau$-n). In some embodiments, the functionality of the one or more banks of correlators (correlator banks 604-1 . . . 604-*n*) can be implemented within a full correlator capable of performing full autocorrelation calculations at a plurality of delays ($\tau$-1 . . . $\tau$-n). In some embodiments, each correlator in the bank of correlators (e.g., correlators 604-1 . . . 604-*n*) can include a corresponding delay component (e.g., delay component 605-1 . . . 605-*n*), a corresponding multiplier component (e.g., multiplier component 606-1 . . . 606-*n*), and a corresponding integration component (e.g., integrator component 608-1 . . . 608-*n***) to perform autocorrelation at a delay (e.g., $\tau 1$ . . . $\tau n$) to decode watermark information.

For example, the radio signal received at antenna 602 can be split into two paths (representing a first and second version of the radio signal) to be processed by correlator 604-1. The first version of the radio signal can be transmitted to multiplier component 606-1 and the second version can be transmitted to delay component 605-1 for applying a delay τ1. Then, the first and second versions of the received radio signal 602 can be multiplied by multiplier component 606-1. Therefore, if the radio signal received from antenna 602 includes an underlying signal and a delayed and scaled copy of that underlying signal added to it, the radio receiver can apply a delay τ1 associated with the delay used by a radio transmitter to generate the delayed and scaled copy of the underlying signal, as described with respect to FIG. 3. In some embodiments, appliqué 600 can implement a plurality of correlators 604-1 . . . 604-*n* with different delays applied by a corresponding plurality of delay components 605-1 . . . 605-*n* to determine the delay used by the transmitter to embed the watermark information in the received radio signal. Accordingly, if the transmitter sent a composite radio signal including an original signal A-1 and a delayed copy A-2, correlator 604-1 can delay the composite radio signal (A-1, A-2) by τ1 using delay component 605-1 to form a delayed received signal (B-1, B-2). The goal is to have B-1 match up with A-2 from the original signal. To do so, correlator 605-1 can perform correlation by multiplying the composite radio signal (A-1, A-2) with the delayed received signal (B-1, B-2) using multiplier component 606-1 and then integrate this product radio signal (i.e., adding these values) using integrator component 608-1 over a chip time (T) representing the chip interval duration. In some embodiments, integrator component 608-1 can be a finite-time integrator. Essentially, since there are multiple delays that may correspond to the radio signal received at antenna 602, the received radio signal can be delayed by τ1 for one correlator, τ2 for a second correlator, . . . , and τn for an nth correlator and so on. These correlators 604-1 . . . 604-*n* can be run in parallel as shown in FIG. 6. In some embodiments, the output of a one of correlators 604-1 . . . 604-*n* (such as correlation 604-1) that used the correct delay (e.g., τ1) can have the highest output compared to the outputs of each of the other correlators. As such, the properties associated with the correct delay can be used to identify the watermark that was sent in the received radio signal.

In some embodiments, the outputs of correlators 604-1 . . . 604-*n* can be sampled by corresponding A/D converters (ADC) 610-1 . . . 610-*n* at sample rates. For example, an output of correlator 604-1 can be sampled by A/D converter 610-1. These sample rates can be related to the chip time, and not to a characteristic of the carrier signal. The outputs from A/D converters 610-1 . . . 610-*n* can be sent to a decoder device 612 to decode the watermark information. For example, decoder device 612 may be a general processor (GPP), a digital-signal processor (DSP), an application-specific integrated circuit (ASIC), and the like. In some embodiments, decoder device 612 can decode a scale (α) used to generate an echo signal in the received radio signal by comparing the outputs of one or more correlators 604-1 . . . 604-*n* once τ is identified.

Figure 13A:
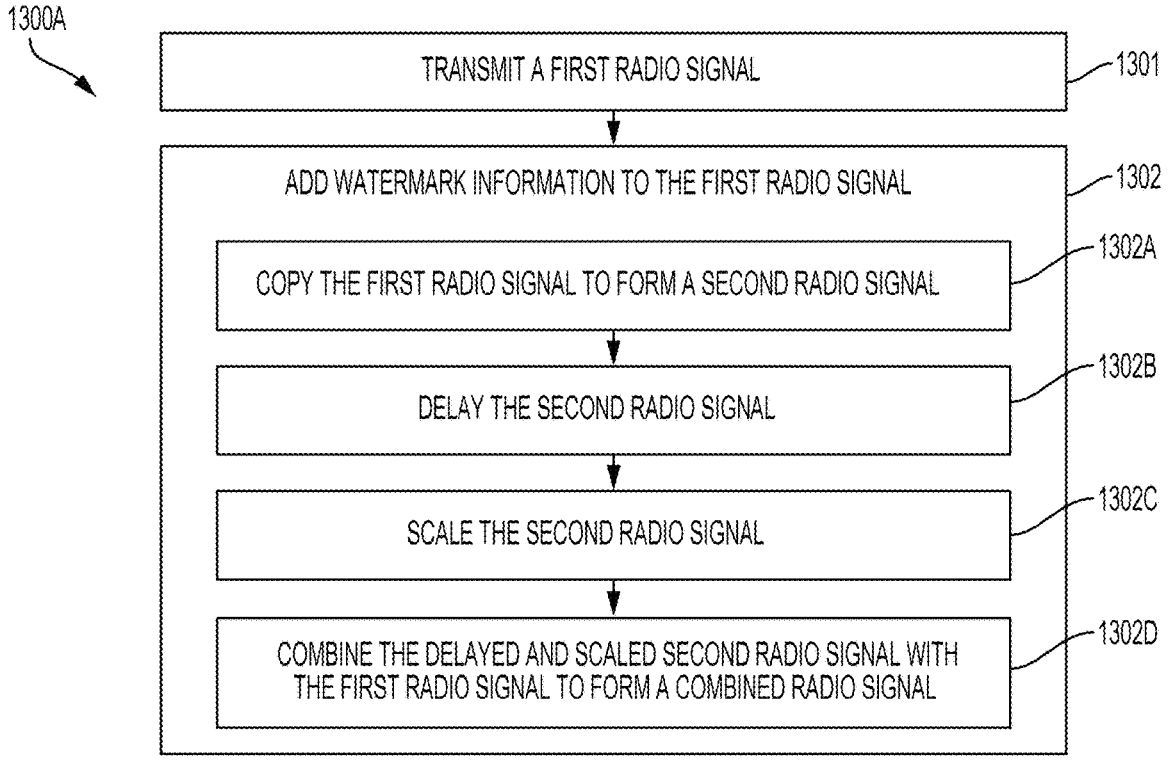
FIG. 13A illustrates a flowchart for a method of adding a watermark to a radio signal, according to some embodiments.

FIG. 13A illustrates a flowchart 1300A for a method of adding a watermark to a radio signal, according to some embodiments. At step 1301, a radio system (e.g., radio 202 of FIG. 2) can transmit a first radio signal. At step 1302, the radio system (e.g., appliqué 204 of FIG. 2) adds watermark information to the first radio signal. In some embodiments, step 1302 can include steps 1302A-D, which may correspond to steps performed by appliqué 300 as described with respect to FIG. 3. In step 1302A, the radio system copies the first radio signal to form a second radio signal. In step 1302B, the radio system delays the second radio signal based on a delay. In step 1302C, the radio system scales the second radio signal based on a scaling value. In step 1302D, the radio system combines the delayed and scaled second radio signal with the initial, first radio signal to form a combined radio signal. Then, the combined radio signal may be transmitted by the radio system, as discussed above with respect to FIGS. 3 and 4. In some embodiments, steps 1302A-D can be repeated to add additional watermarks to the same, first radio signal or subsequent radio signals. In some embodiments, the delay, the scaling value, or both the delay and the scaling value can be selected based on the watermark information.

Figure 13B:
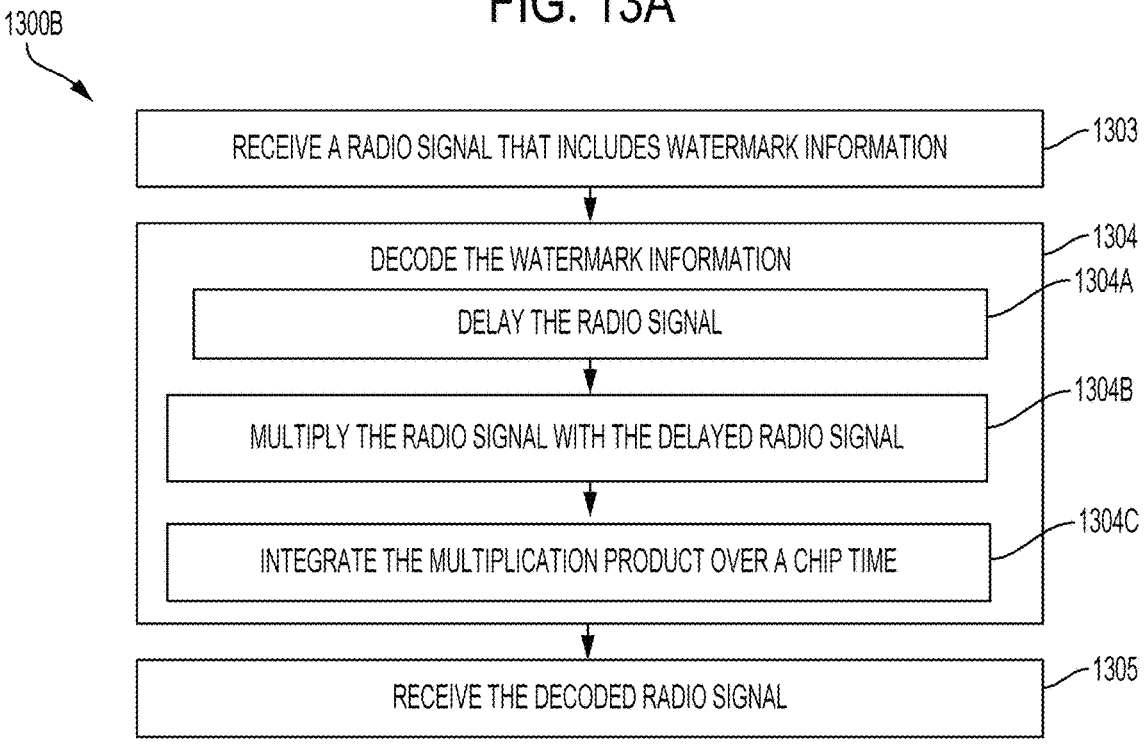
FIG. 13B illustrates a flowchart for a method of decoding a watermark from a radio signal, according to some embodiments.

FIG. 13B illustrates a flowchart 1300B for a method of decoding a watermark from a radio signal, according to some embodiments. At step 1303, a radio system (e.g., appliqué 204 of FIG. 2) receives a radio signal that includes watermark information. In some embodiments, a radio receiver can receive the radio signal from a radio transmitter performing the watermarking process described with respect to method 1300A of FIG. 13A. Accordingly, the radio signal may correspond to a combined radio signal including a first radio signal and a second radio signal (i.e., the watermark) generated based on the first radio signal. In step 1304, the radio system decodes the watermark information from the received radio signal. In some embodiments, step 1304 can include steps 1304A-1304C. In step 1304A, the radio system delays the radio signal from step 1303 by a delay. In step 1304B, the radio system multiplies the radio signal with the delayed radio signal from step 1304A. In step 1304C, the radio system integrates the product signal (i.e., radio signal multiplied by the delayed radio signal) over a chip time. In some embodiments, steps 1304A-1304C can be performed by a plurality of correlators (e.g., correlators 604-1 . . . 604-*n*) using a corresponding plurality of delays (e.g., $\tau_1$ . . . $\tau_n$) to determine a correct delay. In some embodiments, the highest output of a correlator can indicate the delay used by that correlator to generate the highest output is the correct delay. In some embodiments, the above steps can be repeated for as many times as necessary for the various watermarks in a given or subsequent radio signal. In some embodiments, as discussed with respect to method 1300A, the radio signal received at a radio receiver can be a combined radio signal including a first radio signal and a watermark in the form of a second radio signal generated based on the first radio signal. In step 1305, the radio system receives the decoded radio signal for further processing after the watermark has been decoded. In some embodiments, to recover the watermarked/added data embedded in the radio signal received in step 1303, the watermarked data does not need to be compared with an original, unaltered waveform. Instead, as described with respect to FIG. 6, the radio system can recover the watermarked data without such a reference and using just the received radio signal of step 1303.

Figure 12:
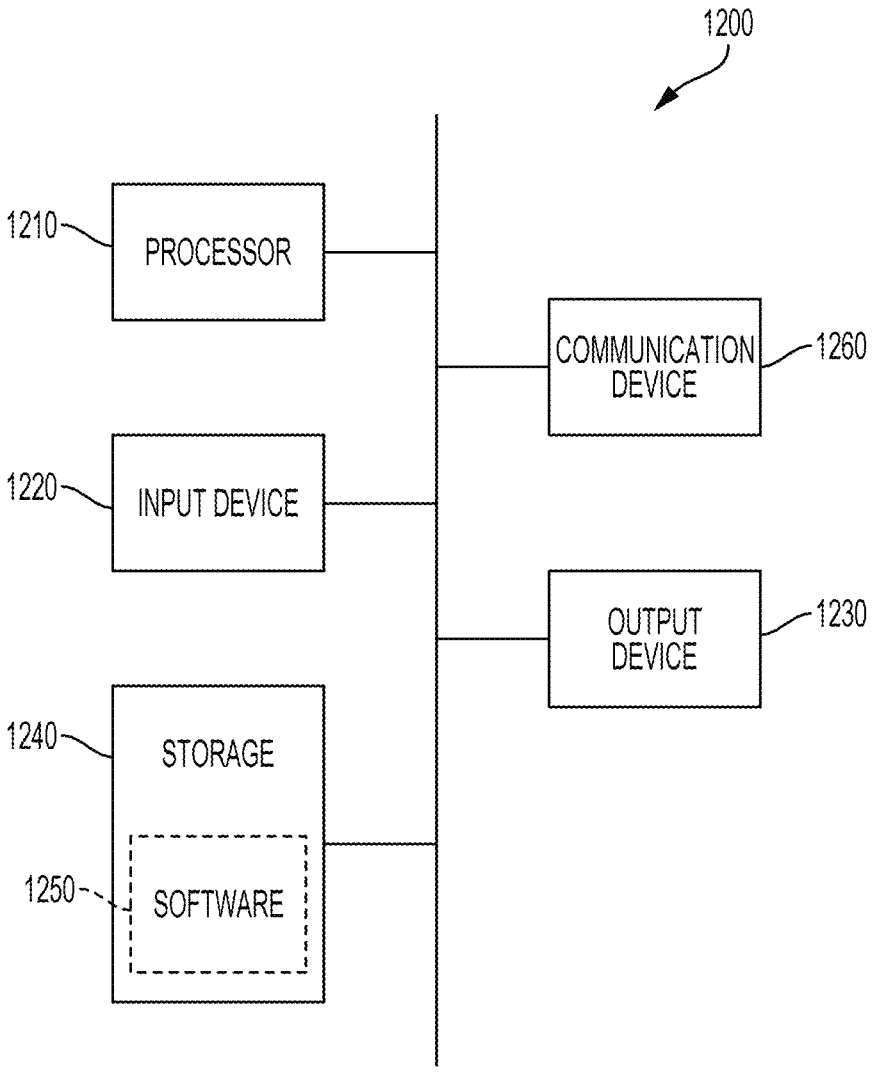
FIG. 12 illustrates an example of a computer in accordance with one embodiment.

FIG. 12 illustrates an example of a computer in accordance with one embodiment. Computer 1200 can be a component of a system for implementing the algorithms, methods, and systems described above, such as the watermark transmission of FIG. 3, or can include the entire system itself. In some embodiments, computer 1200 is configured to perform a method for watermark reception of FIG. 6. Computer 1200 can be a host computer connected to a network. Computer 1200 can be a client computer or a server. As shown in FIG. 12, computer 1200 can be any suitable type of microprocessor-based device, such as a personal computer, workstation, server, or handheld computing device, such as a phone or tablet. The computer can include, for example one or more of processor 1210, input device 1220, output device 1230, storage 1240, and communication device 1260. Input device 1220 and output device 1230 can generally correspond to those described above and can either be connectable or integrated with the computer.

Input device 1220 can be any suitable device that provides input, such as touch screen or monitor, keyboard, mouse, or voice-recognition device. Output device 1230 can be any suitable device that provides output, such as a touch screen, monitor, printer, disk drive, or speaker.

Storage 1240 can be any suitable device that provides storage, such as an electrical, magnetic, or optical memory, including a RAM, cache, hard drive, CD-ROM drive, tape drive, or removable storage disk. Communication device 1260 can include any suitable device capable of transmitting and receiving signals over a network, such as a network interface chip or card. The components of the computer can be connected in any suitable manner, such as via a physical bus or wirelessly. Storage 1240 can be a non-transitory computer readable storage medium comprising one or more programs, which, when executed by one or more processors, such as processor 1210, cause the one or more processors to perform methods described herein.

Software 1250, which can be stored in storage 1240 and executed by processor 1210, can include, for example, the programming that embodies the functionality of the present disclosure (e.g., as embodied in the systems, computers, servers, and/or devices as described above). In some embodiments, software 1250 can include a combination of servers such as application servers and database servers.

Software 1250 can also be stored and/or transported within any computer-readable storage medium for use by or in connection with an instruction execution system, apparatus, or device, such as those described above, that can fetch instructions associated with the software from the instruction execution system, apparatus, or device and execute the instructions. In the context of this disclosure, a computer-readable storage medium can be any medium, such as storage 1240, that can contain or store programming for use by or in connection with an instruction execution system, apparatus, or device.

Software 1250 can also be propagated within any transport medium for use by or in connection with an instruction execution system, apparatus, or device, such as those described above, that can fetch instructions associated with the software from the instruction execution system, apparatus, or device and execute the instructions. In the context of this disclosure, a transport medium can be any medium that can communicate, propagate, or transport programming for use by or in connection with an instruction execution system, apparatus, or device. The transport readable medium can include, but is not limited to, an electronic, magnetic, optical, electromagnetic, or infrared wired or wireless propagation medium.

Computer 1200 may be connected to a network, which can be any suitable type of interconnected communication system. The network can implement any suitable communications protocol and can be secured by any suitable security protocol. The network can comprise networks links of any suitable arrangement that can implement the transmission and reception of network signals, such as wireless network connections, T1 or T3 lines, cable networks, DSL, or telephone lines.

Computer 1200 can implement any operating system suitable for operating on the network. Software 1250 can be written in any suitable programming language, such as C, C++, Java, Swift, Objective-C or Python. In various embodiments, application software embodying the functionality of the present disclosure can be deployed in different configurations, such as in a client/server arrangement or through a Web browser as a Web-based application or Web service, for example.

Examples

The techniques described herein were analyzed mathematically and simulated in MATLAB to evaluate the performance of the watermark and to ensure the underlying waveform was not significantly impacted. In particular, the technique was implemented on hardware using two Software Defined Radios (SDR) to verify that the disclosed techniques work. The implementation consisted of developing an ADS-B transmitter, upgrading an open source ADS-B receiver, and developing multiple custom GNU Radio blocks to add and receive the watermark. As a demonstration, a watermarked ADS-B transmission was compared with an un-watermarked ADS-B transmission and the receiver was shown to be able to distinguish between the two types of ADS-B transmissions.

Figure 7:
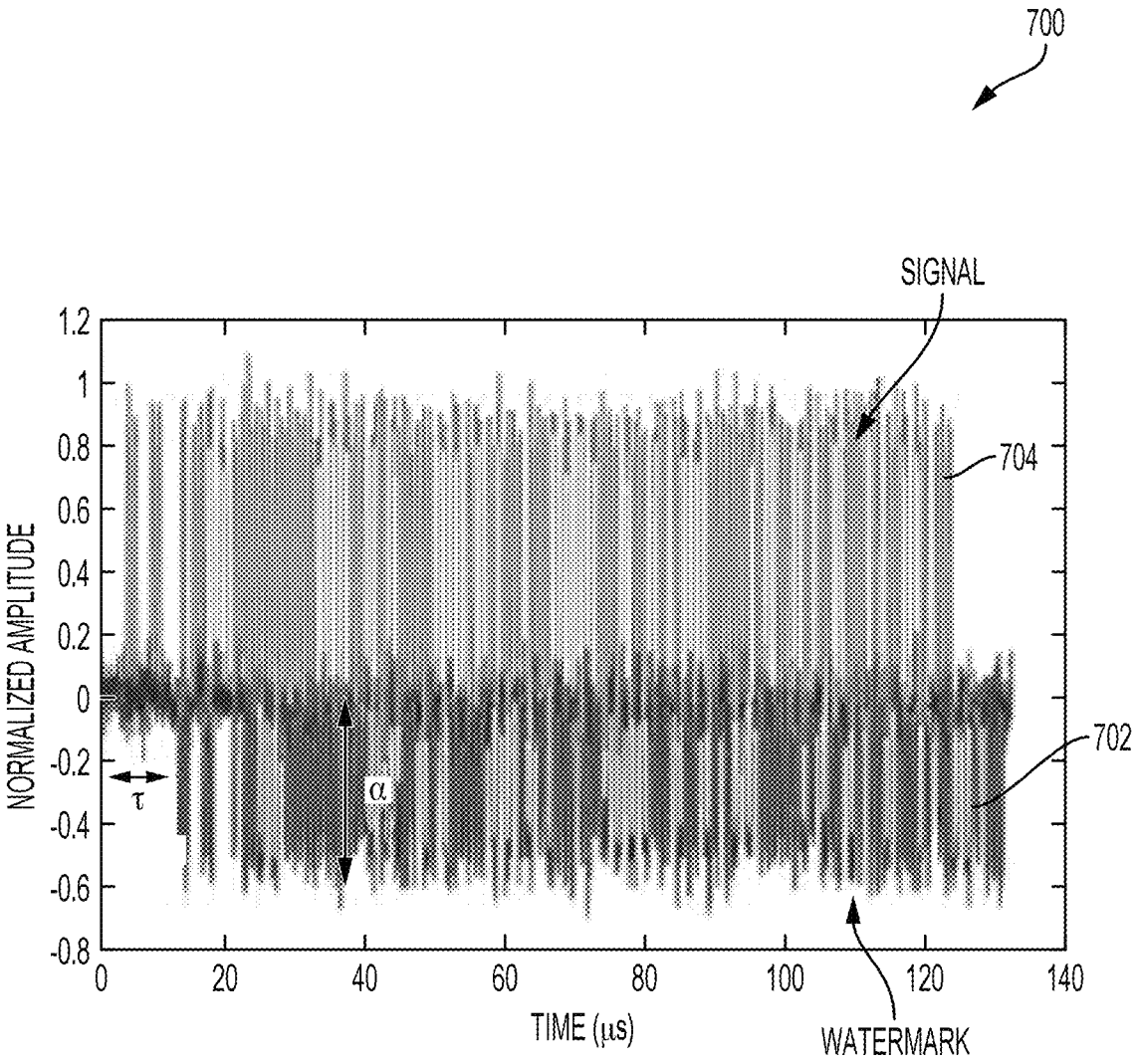
FIG. 7 illustrates a graph of an example watermarked signal, according to some embodiments.

In the software simulation, Applicants built an ADS-B transmitter and an ADS-B receiver in MATLAB, designed using DO-260S MOPS (1090 ES performance spec) as a guide, and added a watermark transmitter (e.g., a FIR filter) and receiver (e.g., a correlator bank) on top also using MATLAB. The two main performance tradeoffs were how do the parameters $\tau$ and $\alpha$ affect the performance of both the watermark and the ADS-B reception. FIG. 7 illustrates a graph 700 of an example watermarked signal, with the original signal 704 on the top and the echo signal 702 on bottom with a delay ($\tau$) and a scale ($\alpha$) labeled. As discussed above with respect to FIG. 3, the echo signal 702 may be original signal 704 that is delayed by $\tau$ and scaled by $\alpha$.

Figure 8:
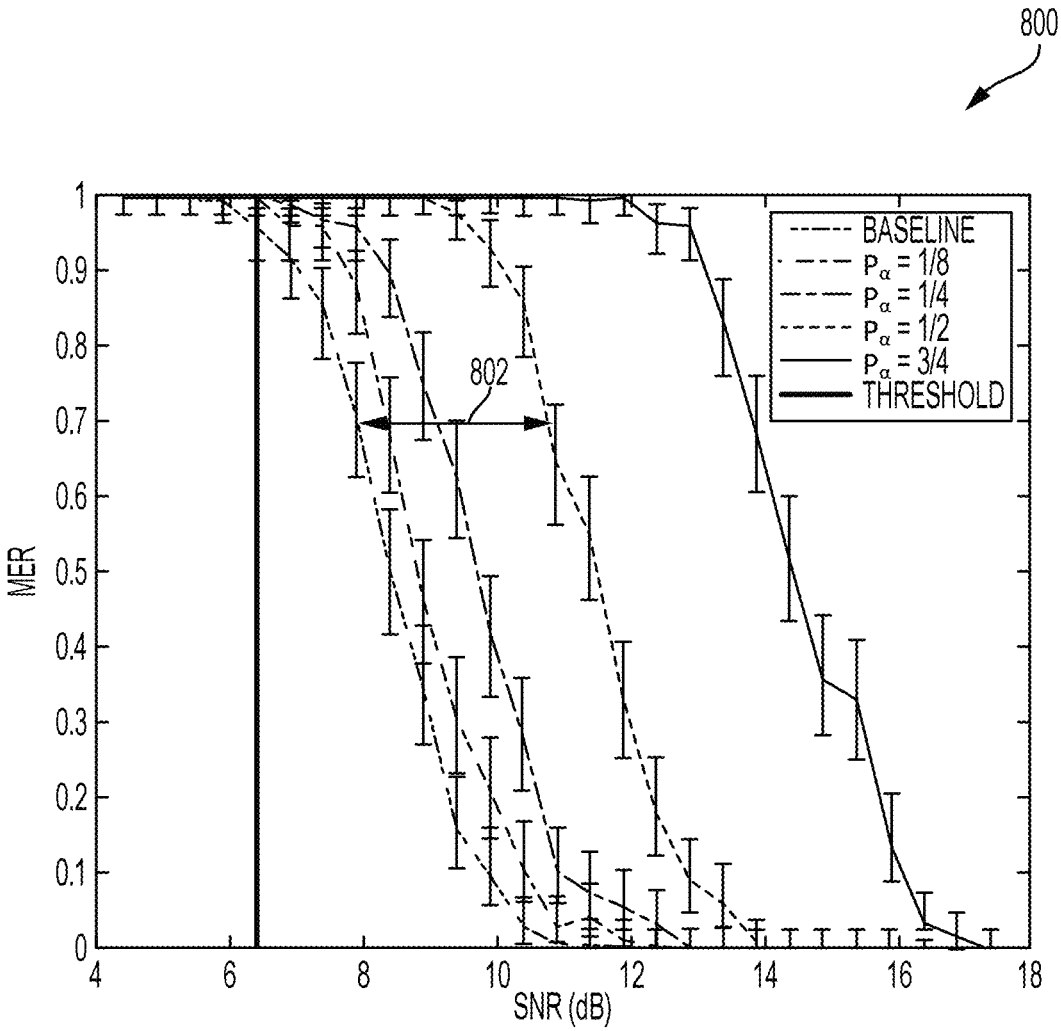
FIG. 8 illustrates a graph showing Message Error Rate (MER) of an ADS-B receiver for different values of $\alpha$, according to some embodiments.

FIG. 8 illustrates a graph 800 showing Message Error Rate (MER) of the ADS-B receiver for different values of power fraction ($P_\alpha$) representing a fraction of total signal power used to generate echo signal 702. For example, a $P_\alpha$ of 0.25 indicates that 25% of the signal power was used to transmit echo signal 702 and 75% of the signal power was used to transmit original signal 704. Power fraction ($P_\alpha$) is directly proportional to the square of amplitude (a) discussed above with respect to FIG. 7, (i.e., $P_\alpha \sim \alpha$ 2). For example, for an amplitude (a) of 0.5, the power fraction ($P_\alpha$) would be 0.25.

Graph 800 shows how the performance of the ADS-B receiver with respect to the MER changes with varying $P_\alpha$ values. The y-axis is MER (in %) and the x-axis is Signal power/Noise power (SNR) in decibels with a higher SNR meaning more signal power compared to noise power. A decibel value for SNR can be obtained by taking a log of the SNR value in base 10, (i.e., $SNR=10*\log_{10}(\text{Signal power}/\text{Noise power})$). The baseline curve all the way to the left is the basic MER curve for the ADS-B receiver. The goal here was to show that the baseline curve meets the MER requirements from the D0260S Specification. The rest of the curves with other power fractions ($P_\alpha$) (e.g., ⅛, ¼, ½, and ¾, etc.) show the performance of the ADS-B receiver as more power was taken from original signal 704 to transmit echo signal 702 embedding the watermark. Graph 800 shows that the overall curves for different power fractions ($P_\alpha$) looks the same (in terms of shape), so the addition of echo signal 702 including the watermark is not modifying the behavior of the ADS-B receiver. The curves move to the right with an increase in the power fractions ($P\alpha$) because it takes more transient power (i.e., higher SNR) to achieve the same performance because more of the power is used to transmit echo signal 702 including the watermark.

For example, if half of the signal power is used to transmit the watermark, the power fraction ($P_\alpha$) is ½ representing power for ADS-B original signal=½ and power for the watermark (WM)=½. This is compared to the baseline power fraction ($P_\alpha$) of 0 representing power for ADS-B original signal=1 and power for the watermark (WM)=0. In this comparison, to maintain the same performance, i.e., MER, when transmitting the original signal without the watermark (i.e., $P_\alpha$=0) as compared to allocating half of the power to transmit the watermark (i.e., $P_\alpha$=½), the performance in SNR difference 803 is ~3 dB. This means the curve for $P_\alpha$=½ is about 3 dB to the right of the baseline curve. Therefore, the signal power (for transmitting the original signal and the echo signal) need to be increased by 2 times to induce the ~3 dB shift (i.e., an SNR difference of 3 dB=10*log 10(2)). Accordingly, FIG. 8 shows that the main impact implementing the watermark has on the ADS-B receiver performance is a power hit, which one can expect given that power is stolen from transmitting the original signal to transmit the echo signal including the watermark, and no other ill effects from the fact it looks like a multipath. In addition, the ideal value of the power fraction ($P_\alpha$) is small, so the curve is close to the baseline curve, but what $P_\alpha$ values a system can support can require fine tuning based on the performance wanted from the watermark in the echo signal and the underlying waveform in the original signal.

Figure 9:
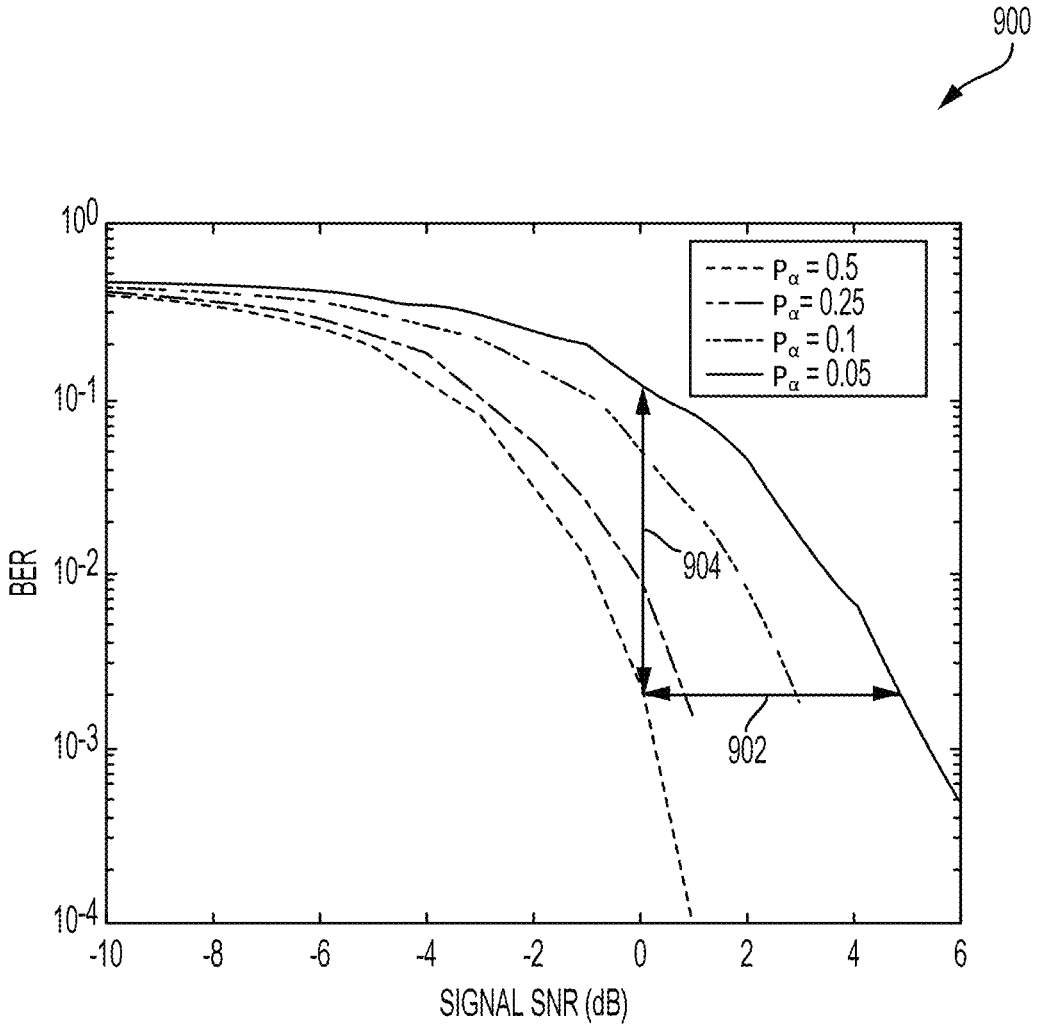
FIG. 9 illustrates a graph showing Bit Error Rate (BER) vs SNR of an ADS-B signal for varying values of $\alpha$, according to some embodiments.

FIG. 9 illustrates a graph showing Bit Error Rate (BER) vs SNR of an ADS-B signal with varying values for power fractions ($P_\alpha$) representing a fraction of total signal power used to transmit echo signal 702. Graph 900 shows how the performance of the watermark with respect to BER varies for different values of the power fraction ($P_\alpha$). BER can represent a probability of a single bit being wrong, while MER can represent a probability of an entire message being wrong. For MER=1, every message will be lost and cannot be recovered. However, for BER, the worst rate is 50% because that represents the rate at which the bit cannot be recovered. If the BER were any higher (i.e., 100% BER), one could always invert the bit being sent to obtain the correct value and the BER will be lower (i.e., 0% BER in this case). For both the MER and BER error types, a lower number is better. In graph 900 FIG. 9, the y-axis shows the BER in log scale vs SNR (in dB) of the ADS-B signal including original signal 702 and echo signal 704 with embedded watermark information. Again, the SNR in dB is generated according to the following relationship: SNR=10*log 10(Signal Power/Noise Power). The "noise floor" can refer to 0 dB, or when ADS-B signal power=noise power (i.e., 0 dB=10*$\log_{10}$(signal power/noise power)). Generally, receivers do not work well below this 0 dB value. Graph 900 shows that implementing the watermark does better, i.e., reduces BER, with more power allocated to transmitting the watermark (i.e., higher $P_\alpha$). As shown in FIG. 9, the same performance, i.e., the same BER, can be achieved with a smaller $P_\alpha$ by increasing total signal power (represented on the y-axis). In general, radios can more easily process radio signals with an SNR value above the noise floor such that the signal power is greater than the noise power. In graph 900, a current power fraction being utilized may be Pα=0.05, which results in a BER of about 0.1 (i.e., 10%). To obtain a BER of, for example, 0.002 (i.e., 0.2%), BER change 904 shows that the power fraction can be increased from Pα=0.05 to Pα=0.5. BER change 904 corresponds to a 10× gain in watermark power (i.e., the power fraction Pα is increased from 0.05 to 0.5). Alternatively, to obtain the same BER of 0.002 while maintaining the power fraction Pα of 0.05, the SNR difference required would be about 5 dB shown in the SNR change 902. An SNR of 5 dB translates to about t a 3× gain in total signal power (i.e., 5 dB=10*log 10(3)). In addition, FIG. 9 shows that if, for some reason, the ADS-B signal is really weak, the watermark message can still be recovered. As such, the watermark information can be decoded even after the actually underlying, original signal (ADS-B here) can no longer be recovered.

Because τ and α (which corresponds to power fraction $P_\alpha$) control the performance of not only implementing the watermark, but the underlying original signal, it is important to know what values can be used for each. These values can depend on what kind of performance is desired. Generally, the smaller the amount of increment of τ by (Δτ), the better because more τ values can fit. The same can hold true for α. As such, the more values of τ and α that can be used, the more data that can be sent.

Figure 10:
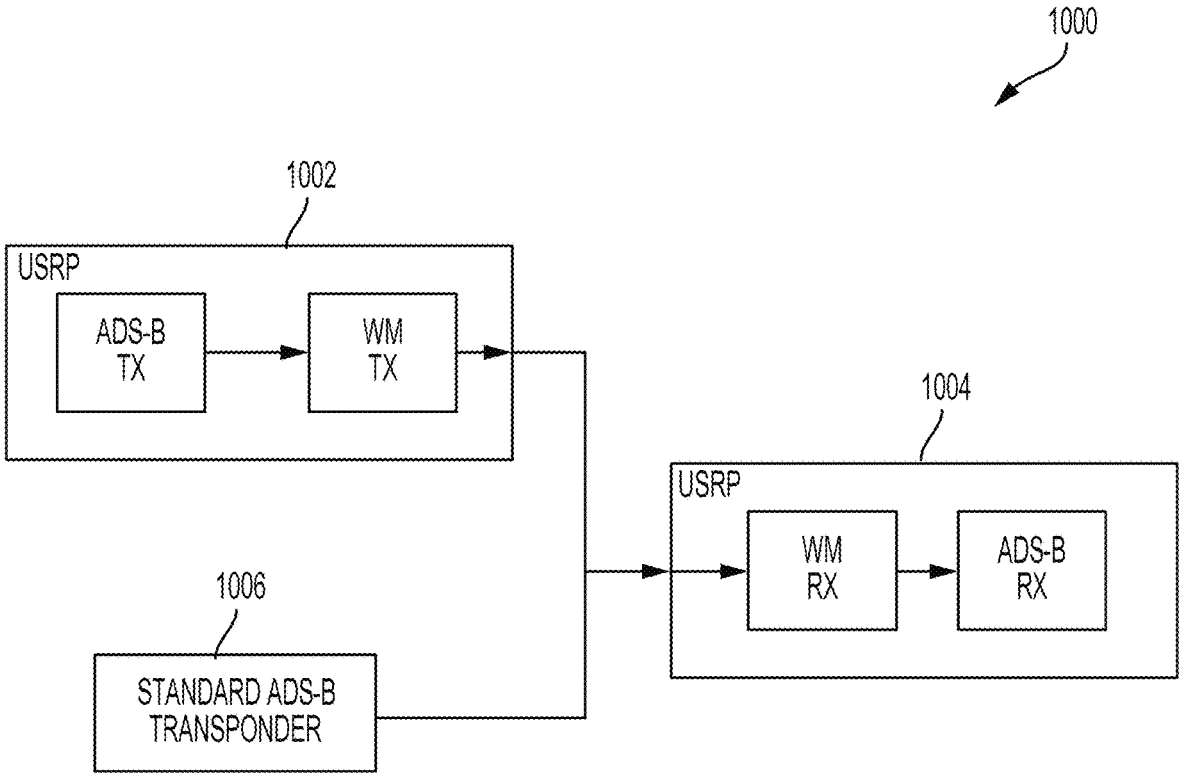
FIG. 10 illustrates an example of an experimental setup, according to some embodiments.

Applicants also implemented the techniques described herein on actual hardware. Applicants used a set of Software Defined Radios (SDRs). The code running on these SDRs was written using GNU Radio, which is a software wrapper for the hardware that can be used to write signal processing code in. The signal processing code was written in C++. The code for the (no watermark) ADS-B transmitter was written and the code for the (no watermark) ADS-B receiver was modified to behave as specified in the DO-260S specification (i.e., to match the MATLAB ADS-B receiver). The code for the watermark transmitter and the watermark receiver were also written. FIG. 10 illustrates the experimental setup 1000. Three SDRs 1002, 1004, and 1006 were used, and they were implemented using Universal Software Radio Peripheral (USRP) devices. SDR 1002 implemented as an USRP has the ADS-B watermark Transmitter (TX) and watermark TX, while the other SDR 1004 implemented as an USRP has the watermark receiver (RX) and the ADS-B receiver. SDR 1006 was implemented using a standard ADS-B transponder to run only the ADS-B TX code. The watermark transmitter on SDR 1002 was sending one ADS-B signal, and the standard ADS-B transponder 1006 was sending a different signal.

Figure 11:
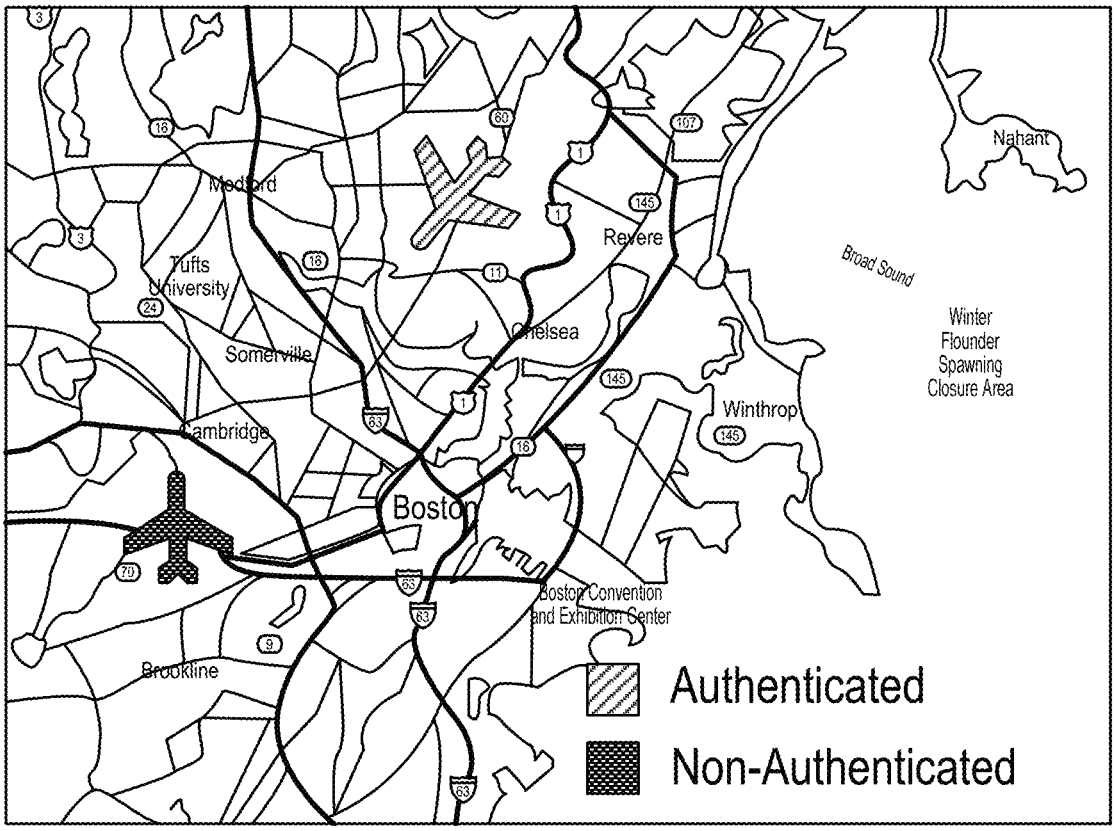
FIG. 11 illustrates a potential watermark receiver's point of view for an example of an experimental setup, according to some embodiments.

FIG. 11 illustrates an example of a result of the experiment setup 1000 of FIG. 10 from the watermark receiver's point of view. For example, the receiver can decode the watermark from SDR 1002 including watermark transmission and can color an aircraft a certain color or pattern (as depicted by the top aircraft in FIG. 11). If the receiver cannot decode any watermark from, for example, SDR 1006 implementing a standard ADS-B, the receiver can color an aircraft a different color or pattern (as depicted by the bottom aircraft in FIG. 11). In contrast, a standard ADS-B receiver would plot both signals as red because the standard ADS-B receiver (does not implement watermark decoding) and cannot authenticate either of them. As such, the ADS-B broadcasts can be plotted to maps such as Google maps for example. As such, an augmented receiver can extract authentication when present. However, legacy receivers are able to receive both signals without change.

The analysis results showed that the performance of ADS-B is nominally affected by the presence of the watermark, while the watermark itself can be received when the signal to noise ratio (SNR) of the signal drops below what ADS-B receivers are designed to support. The watermark does degrade the receiver's capability of handling more extreme multipath scenarios though, which establishes a cost for the additional information. Furthermore, watermarking can provide the FAA and others with a relatively low cost solution to layering supplemental information (e.g., authentication) on existing legacy waveforms.

The above description is presented to enable a person skilled in the art to make and use the disclosure, and is provided in the context of a particular application and its requirements. Various modifications to the preferred embodiments will be readily apparent to those skilled in the art, and the generic principles defined herein may be applied to other embodiments and applications without departing from the spirit and scope of the disclosure. Thus, this disclosure is not intended to be limited to the embodiments shown, but is to be accorded the widest scope consistent with the principles and features disclosed herein. Finally, the entire disclosure of the patents and publications referred in this application are hereby incorporated herein by reference.

The invention claimed is:

1. A system, comprising:

a radio transmitter that transmits a radio signal;

a watermark transmitter that adds watermark information to the radio signal based on applying a synthetic multipath channel to a copy of the radio signal to generate an echo signal and transmitting a composite radio signal comprising the echo signal added to the radio signal, wherein the watermark transmitter is configured to apply the synthetic multipath channel by:

selecting a delay and a scale based on a specific value of the watermark information to be embedded, delaying the copy of the radio signal by the selected delay, and scaling the copy of the radio signal by the selected scale, wherein the delayed and scaled copy of the radio signal corresponds to the echo signal embedding the specific value of the watermark information;

a watermark receiver that receives the composite radio signal comprising the watermark information, wherein the watermark receiver can decode the watermark information; and a radio receiver that receives the decoded radio signal.

2. The system of claim 1, wherein the watermark information comprises authentication information.

3. The system of claim 2, wherein the authentication information is generated using Timed Efficient Stream Loss-Tolerant Authentication (TESLA).

4. The system of claim 1, wherein the radio signal is a legacy waveform.

5. The system of claim 4, wherein the legacy waveform comprises Automatic Dependent Surveillance-Broadcast (ADS-B).

6. The system of any of claim 1, wherein decoding the watermark information comprises:

delaying the composite radio signal;

multiplying the combined radio signal with the delayed composite radio signal to form a product radio signal; and integrating the product radio signal over a chip time.

7. The system of claim 1, wherein the watermark transmitter is attached to an output port of the radio transmitter.

8. The system of claim 1, wherein the watermark receiver is attached to an input port of the radio receiver.

9. A method, comprising:

transmitting a radio signal;

adding watermark information to the radio signal based on applying a synthetic multipath channel to a copy of the radio signal to generate an echo signal, wherein applying the synthetic multipath channel comprises:

selecting a delay and a scale based on a specific value of the watermark information to be embedded, delaying the copy of the radio signal by the selected delay, and scaling the copy of the radio signal by the selected scale, wherein the delayed and scaled copy of the radio signal corresponds to the echo signal embedding the specific value of the watermark information;

transmitting a composite radio comprising the echo signal added to the radio signal;

receiving the composite radio signal comprising watermark information;

decoding the watermark information; and receiving the decoded radio signal.

10. The method of claim 9, wherein the watermark information comprises authentication information.

11. The method of claim 10, wherein the authentication information is generated using Timed Efficient Stream Loss-Tolerant Authentication (TESLA).

12. The method of claim 9, wherein the radio signal is a legacy waveform.

13. The method of claim 12, wherein the legacy waveform comprises Automatic Dependent Surveillance-Broadcast (ADS-B).

14. The method of any of claim 9, wherein decoding the watermark information comprises:

delaying the composite radio signal;

multiplying the combined radio signal with the delayed composite radio signal to form a product radio signal; and integrating the product radio signal over a chip time.

15. The system of claim 1, wherein to add the watermark information to the radio signal, the watermark transmitter is configured to generate a plurality of echo signals by applying a plurality of respective synthetic channels to the radio signal and adding the plurality of generated echo signals to the composite radio signal.

16. The method of claim 9, wherein adding the watermark information to the radio signal comprises:

generating a plurality of echo signals by applying a plurality of respective synthetic channels to the radio signal; and adding the plurality of generated echo signals to the composite radio signal.

17. The system of claim 1, wherein each unique combination of the delay and the scale embeds a different value.

18. The method of claim 9, wherein each unique combination of the delay and the scale embeds a different value.

* * * * *